US006556120B2

(12) United States Patent
Endo et al.

(10) Patent No.: US 6,556,120 B2
(45) Date of Patent: Apr. 29, 2003

(54) FUSE

(75) Inventors: Takayoshi Endo, Shizuoka (JP); Norihiro Ohashi, Shizuoka (JP); Eiji Shimochi, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/003,073

(22) Filed: Dec. 6, 2001

(65) Prior Publication Data

US 2002/0041224 A1 Apr. 11, 2002

Related U.S. Application Data

(62) Division of application No. 09/781,415, filed on Feb. 13, 2001.

(30) Foreign Application Priority Data

May 16, 2000 (JP) ..... 2000-143952

(51) Int. Cl.[7] ..... H01H 85/153; H01H 85/143; H01H 85/20

(52) U.S. Cl. ..... 337/198; 337/159; 337/194; 337/197

(58) Field of Search ..... 337/158–166, 337/180, 186, 187, 198, 227, 251, 252, 290, 295, 296, 217, 260–264, 194, 197; 29/623

(56) References Cited

U.S. PATENT DOCUMENTS

| | | | | |
|---|---|---|---|---|
| 819,657 A | * | 5/1906 | Hubbell | 235/87 R |
| 2,186,813 A | * | 1/1940 | Adam et al. | 337/194 |
| 3,358,100 A | * | 12/1967 | Schleicher | 337/194 |
| 3,909,767 A | | 9/1975 | Williamson et al. | |
| 3,993,395 A | * | 11/1976 | Taylor | 439/698 |
| 4,056,884 A | | 11/1977 | Williamson et al. | |
| 4,224,592 A | | 9/1980 | Urani et al. | |
| 4,391,485 A | | 7/1983 | Urani | |
| 4,417,225 A | | 11/1983 | Müller et al. | |
| 4,604,602 A | | 8/1986 | Borzoni | |
| 4,672,729 A | | 6/1987 | Oh | |
| 4,682,140 A | | 7/1987 | Diaz-Noriega | |
| 5,055,071 A | * | 10/1991 | Carlson et al. | 337/187 |
| 5,139,443 A | | 8/1992 | Armando | |
| 5,227,759 A | | 7/1993 | Hatagishi | |
| 5,229,739 A | | 7/1993 | Oh et al. | |
| 5,293,147 A | | 3/1994 | Oh et al. | |
| 5,668,521 A | | 9/1997 | Oh | |
| 5,854,583 A | | 12/1998 | Falchetti | |
| 5,973,418 A | * | 10/1999 | Ciesielka et al. | 307/112 |
| 6,075,689 A | | 6/2000 | Mitchell | |

FOREIGN PATENT DOCUMENTS

| | | |
|---|---|---|
| CH | 656979 | 7/1986 |
| DE | 20 19 298 A | 5/1971 |

(List continued on next page.)

OTHER PUBLICATIONS

Patent Abstracts of Japan vol. 1998, No. 02, Jan. 30, 1998 & JP 09 283001 A (Sumitomo Wiring Syst Ltd), Oct. 31, 1997 *abstract*.

*Primary Examiner*—Anatoly Vortman
(74) *Attorney, Agent, or Firm*—Sughrue Mion, PLLC

(57) ABSTRACT

A fuse (20) includes a fuse element (25), having a fusible portion (22) provided between inner side edges (21*a*) of a pair of parallel flat-plate terminal portions (21, 21), and an insulating housing (23) covering the inner side edges (21*a*) of the flat-plate terminal portions (21) and the fusible portion (22). A middle portion (21*f*) of each of the flat-plate terminal portions (21), located at the lateral position relative to the fusible portion (22), is fixedly gripped by a mating terminal (11) of a fuse mounting portion, so that the flat-plate terminal portion is electrically connected to the mating terminal.

14 Claims, 7 Drawing Sheets

FOREIGN PATENT DOCUMENTS

| | | | | |
|---|---|---|---|---|
| DE | 25 00 364 | | 7/1975 | |
| DE | 27 14 797 | A | 2/1979 | |
| DE | 3040884 | | 5/1982 | |
| DE | 86 09 415 | U | 6/1986 | |
| DE | 3542349 | A1 * | 6/1987 | ..... H01H/85/20 |
| EP | 0 285 489 | A | 10/1998 | |
| FR | 2 557 355 | A | 6/1985 | |
| GB | 2 090 081 | | 12/1981 | |
| JP | 56-2560 | | 1/1981 | |
| JP | 56 002561 | U | 1/1981 | |
| JP | 54-133203 | | 5/1981 | |
| JP | 56 051239 | U | 5/1981 | |
| JP | 56-90354 | | 7/1981 | |
| JP | 56-92862 | | 12/1982 | |
| JP | 57-204647 | | 12/1982 | |
| JP | H1-591 | | 1/1983 | |
| JP | 58-154549 | | 10/1983 | |
| JP | 56-2561 | | 8/1992 | |
| JP | 2000-260290 | | 9/2000 | |
| JP | 2000-260294 | | 9/2000 | |
| WO | WO 96 29722 | A | 9/1996 | |

* cited by examiner

FUSE

This is a divisional of application Ser. No. 09/781,415 filed Feb. 13, 2001; the disclosure of which is incorporated herein by reference.

BACKGROUND OF THE INVENTION

1. Field of the Invention

The present invention relates to a fuse. More particularly, the present invention relates to a blade-type fuse in which a fuse element, having a fusible portion provided between a pair of parallel flat-plate terminal portions, is mounted within an insulating housing.

The present application is based on Japanese Patent Application No. 2000-143952, which is incorporated herein by reference.

2. Description of the Related Art

A related fuse 50, shown in FIG. 7, is a blade-type fuse in which a fuse element 56 is formed by providing a fusible portion 52 between a pair of parallel flat-plate metal terminals (hereinafter referred to as "flat-plate terminals") 51 and 51, and a proximal end portion of this fuse element 56 (at which the fusible portion 52 is provided) is received in an insulating housing 53.

Each of the flat-plate terminals 51 includes a terminal body portion 54, received in the insulating housing 53, and a tab terminal portion 55 considerably projecting outwardly (downwardly in FIG. 7) from the insulating housing 53.

The fusible portion 52, having a predetermined cross-sectional area, extends between opposed inner side edges 54*a* and 54*a* of the flat-plate terminals 51 and 51.

As shown in FIG. 8, the fuse 50 is mounted in a fuse mounting portion 60 such as a fuse box, and the tab terminal portions 55 are fixedly gripped by mating terminals 61 of the fuse mounting portion 60, respectively, and therefore are electrically connected to these mating terminals 61, respectively.

As shown in FIG. 9, the mating terminal 61 is, for example, a so-called tuning fork-type connection terminal comprising a terminal piece portion formed at one end of a bus bar, and a distal end portion of this terminal piece portion is bifurcated by a slot 61*b* of a U-shaped contour extending in a direction of extending of the terminal piece portion, and upper ends of this bifurcated distal end portion are bulged inwardly toward each other to form a pair of gripping portions 61*a* and 61*a*, respectively.

However, if the tab terminal portions 55 (the lower portions of the flat-plate terminals 51 in FIG. 9) are merely supported by and fixed to the mating terminals 61, respectively, when the fuse 50 is mounted in the fuse mounting portion 60, the balance of supporting of the fuse in the fuse mounting portion 60 is not good.

Therefore, fuse guide walls 62, which support the insulating housing 53, and serve to guide the insertion of the fuse during the mounting operation and also to prevent the deflection and the like of the fuse 50 in its mounted condition, must be provided at the fuse mounting portion 60 as shown in FIG. 8.

The fuse mounting portion 60 has an insulating wall 63 for preventing a leakage of current between the tab terminal portions 55 and 55 of the mounted fuse 50. This insulating wall 63 need to have a sufficient height in the direction of the length of the tab terminal portions 55 and 55 considerably projecting outwardly from the insulating housing 53. An upper end of the insulating wall 63 is abutted against a lower end edge of the insulating housing 53, thereby positioning the fuse 50 relative to the fuse mounting portion 60.

Therefore, the height of the fuse mounting portion 60 in the fuse-mounting direction is increased because of the provision of the fuse guide walls 62 and the insulating wall 63, and this has invited a problem that the fuse box or the like is increased in size. In addition, the fuse guide walls 62 need to have a high molding precision so as to prevent the deflection of the fuse 50.

And besides, for mounting the fuse 50 in the fuse mounting portion 60, each tab terminal portion 55 must be gripped by the gripping portions 61*a* and 61*a* of the mating terminal 61 disposed in a deep bottom portion enclosed by the fuse guide wall 62 and the insulating wall 63, and therefore the efficiency of the inserting operation was not good.

Furthermore, the tab terminal portions 55 of the flat-plate terminals 51 of the fuse element 56 considerably project outwardly from the insulating housing 53, and therefore there have been encountered problems that upon contact of a plurality of fuses 50 with each other during transport or others, the tab terminal portions 55 of these fuses are damaged, and that the fusible portion 52 is liable to be deformed or broken by an external force applied to the tab terminal portions 55 upon contact with other member.

SUMMARY OF THE INVENTION

Therefore, it is an object of the present invention to solve the above problems, and more specifically to provide a good fuse in which a balance of supporting of the fuse in a fuse mounting portion is enhanced, and the fuse mounting portion can be formed into a small size, and the efficiency of an inserting operation can be enhanced, and besides the deformation and breakage of a fusible portion by an external force can be prevented.

To achieve the above object, according to the first aspect of the present invention, there is provided a fuse which comprises a fuse element including a pair of parallel flat-plate terminal portions, and a fusible portion formed between inner side edges of the flat-plate terminal portions; and an insulating housing covering the fusible portion and upper end edges and the inner side edges of the flat-plate terminal portions, wherein a middle portion of each of the flat-plate terminal portions in a mounting direction of the fuse can be fixedly gripped between gripping portions of each mating terminal of a fuse mounting portion in a plate thickness direction of the flat-plate terminal portions, so that the flat-plate terminal portions are electrically connected respectively to the mating terminals.

To achieve the above object, according to the second aspect of the present invention, there may be provided a fuse which comprises a fuse element including a pair of parallel flat-plate terminal portions, and a fusible portion formed between inner side edges of the flat-plate terminal portions; and an insulating housing covering the fusible portion and upper end edges and the inner side edges of the flat-plate terminal portions, wherein middle portions of the flat-plate terminal portions, that are respectively located at lateral positions relative to the fusible portion, can be fixedly gripped between gripping portions of mating terminals of a fuse mounting portion in a plate thickness direction of the flat-plate terminal portions.

In the above construction, the fuse element, in which the inner side edges and upper end edges of the flat-plate terminal portions and the fusible portion are covered with the insulating housing, does not have any tab terminal portions considerably projecting outwardly from the insulating housing as in the related fuse.

Therefore, even when a plurality of fuses are brought into contact with each other during transport or others, the fuse elements, each having no tab terminal portion projecting from the insulating housing, are not liable to be brought into contact with each other, and besides are not liable to receive an external force which would be produced upon contact with other member. Therefore, the flat-plate terminal portions are prevented from damage, and also an external force is prevented from being applied to the fusible portion, thus preventing the fusible portion from being deformed or broken.

The middle portion of each flat-plate terminal portion of the fuse element in the mounting direction is fixedly gripped by the mating terminal in the direction of the plate thickness of the flat-plate terminal portion. Therefore, as compared with the related fuse in which the tab portions, projecting from the insulating housing, are adapted to be fixedly supported, the balance of supporting of the fuse in the fuse mounting portion is better, and the deflection of the fuse in its mounted condition is suppressed, and besides the overall height of the fuse can be reduced.

Therefore, fuse guide walls of the fuse mounting portion do not need to have a high molding precision so as to prevent the deflection and the like of the fuse, and also the height of the fuse guide walls can be reduced. Therefore, the fuse mounting portion can be formed into a small size, and besides the efficiency of the fuse-inserting operation can be enhanced.

In the case where the middle portion of each flat-plate terminal portion, that is located at a lateral position relative to the fusible portion, is adapted to be fixedly gripped by the mating terminal of the fuse mounting portion in the direction of the plate thickness of the flat-plate terminal portion, the substantially central portion of each flat-plate terminal portion in the mounting direction is fixedly gripped by the mating terminal in the direction of the plate thickness of the flat-plate terminal portion, and by doing so, the balance of supporting of the fuse in the fuse mounting portion is made better.

Further, according to the third aspect of the present invention, it is preferable that the insulating housing includes positioning abutment portions which abut respectively against the mating terminals so as to position the fuse when the fuse is mounted to the fuse mounting portion. In this case, the fuse is directly positioned relative to the mating terminals, and therefore the fuse does not need to be positioned relative to the insulating wall and others of the fuse mounting portion, so that the accurate positioning can be effected regardless of the molding precision of the fuse mounting portion.

Further, according to the fourth aspect of the present invention, it is preferable that the insulating housing covers outer side edges of the flat-plate terminal portions. With this construction, the exposure of the fuse element is reduced to the minimum of the required amount, and therefore the damage prevention and the protection of the fusible portion can be achieved more positively.

Further, according to the fifth aspect of the present invention, it is preferable that the insulating housing comprises a pair of housing members which are integrally connected together in a manner to hold the fuse element therebetween in the plate thickness direction of the flat-plate terminal portions, and a pair of large and small pins are formed on and project from an inner surface of each of the housing members, and wherein the pins pass respectively through corresponding through holes, formed through the flat-plate terminal portions, and then are fitted respectively in fitting holes formed in the inner surface of the housing member to which the pins are opposed. With this construction, even if the outer side edges and lower end edges of the flat-plate terminal portions receive an external force due to contact with another member, the external force is not directly applied to the fusible portion easily because the flat-plate terminal portions are penetrated and supported by the pins of each of the housing members.

DETAILED DESCRIPTION OF THE PREFERRED EMBODIMENTS

One preferred embodiment of a fuse of the present invention will now be described in detail with reference to the accompanying drawings.

Figure 1:
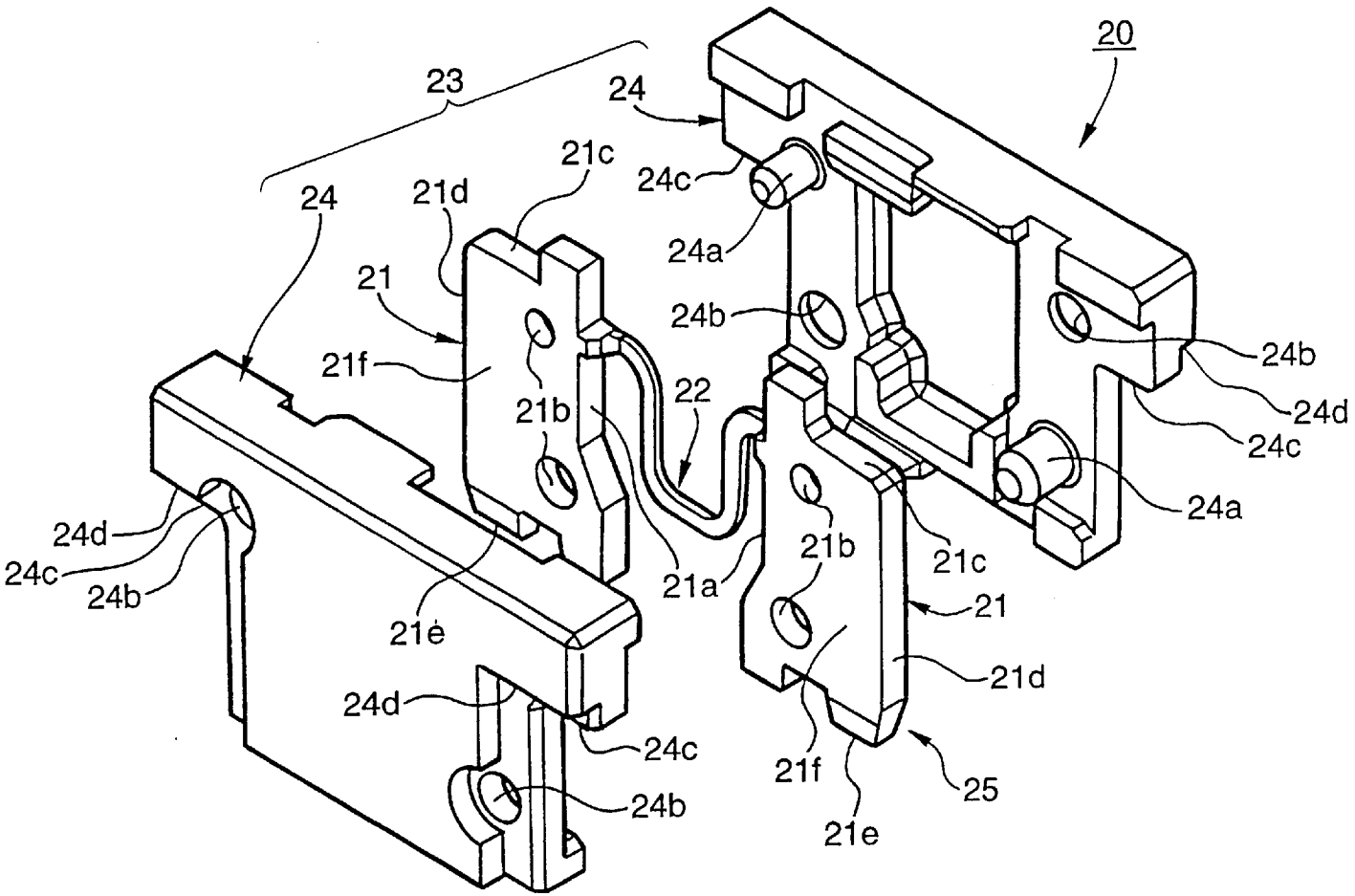
FIG. 1 is an exploded, perspective view showing a first embodiment of a fuse of the present invention.
Figure 2:
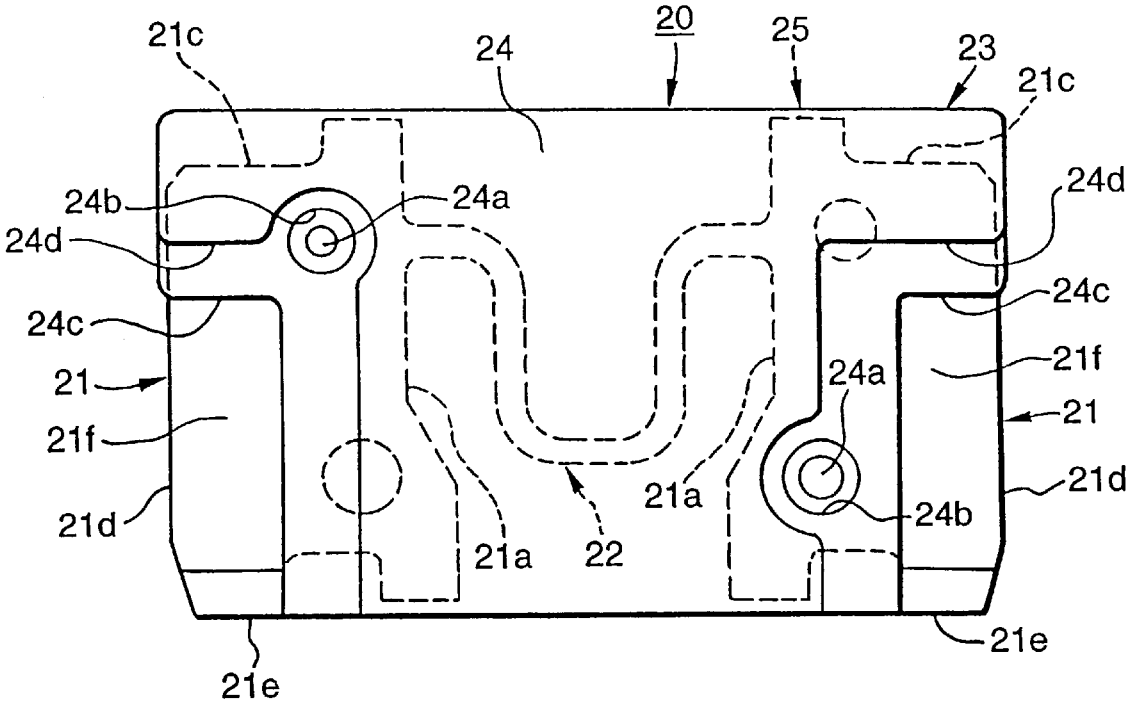
FIG. 2 is a front-elevational view of the fuse of FIG. 1.
Figure 3:
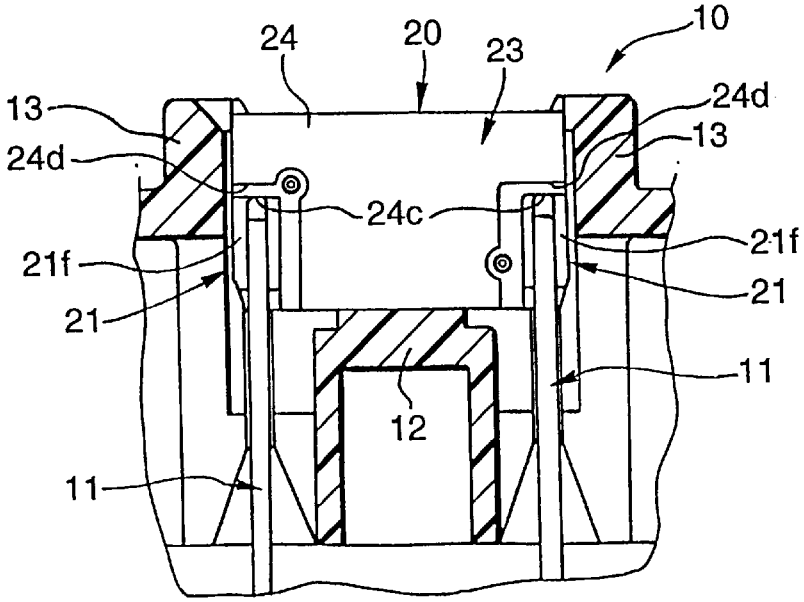
FIG. 3 is a front-elevational view showing a condition in which the fuse of FIG. 1 is mounted in a fuse mounting portion.
Figure 4:
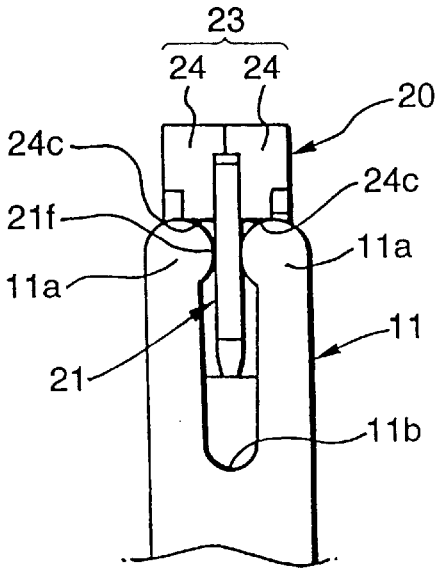
FIG. 4 is a side-elevational view showing a condition in which the fuse of FIG. 1 is mounted in the fuse mounting portion.

FIG. 1 is an exploded, perspective view showing the first embodiment of the fuse of the present invention, FIG. 2 is a front-elevational view of the fuse of FIG. 1, and FIGS. 3 and 4 are a front-elevational view and a side-elevational view, respectively, showing a condition in which the fuse of FIG. 1 is mounted in a fuse mounting portion.

The fuse 20 of this first embodiment is a blade-type fuse in which a fuse element 25, having a fusible portion 22 provided between a pair of parallel flat-plate terminal portions 21 and 21, is mounted within an insulating housing 23.

Each of the flat-plate terminal portions 21 has a substantially rectangular shape, and the fusible portion 22, having a predetermined cross-sectional area, extends between opposed inner side edges 21*a* and 21*a* of the flat-plate terminal portions 21 and 21.

The insulating housing 23 comprises a pair of housing members 24 and 24 of a substantially T-shape, and these housing members are integrally connected together in a manner to hold the fuse element 25 therebetween in a direction of a plate thickness of this fuse element, and are fixed together by welding. A pair of large and small pins 24*a* and 24*a* are formed on and project from an inner surface of each of the, housing members 24, and these pins pass respectively through corresponding through holes 21*b*, formed through the flat-plate terminal portions 21, and then are fitted respectively in fitting holes 24*b* formed in the inner surface of the housing member 24 to which these pins 24*a* are opposed.

Therefore, the insulating housing 23, attached to the fuse element 25, covers the fusible portion 22 and the inner side edges 21*a* and upper end edges 21*c* of the flat-plate terminal portions 21. Therefore, as shown in FIG. 2, the fuse element 25 is covered with the insulating housing 23 except obverse and reverse sides of that portion of each flat-plate terminal portion 21 extending from its outer side edge 21*d* and lower end edge 21*e* to a region including a middle portion 21*f* thereof located at the lateral position relative to the fusible portion 22.

Then, the middle portion 21*f* of each flat-plate terminal portion 21 is fixedly gripped by a mating terminal 11 of the fuse mounting portion 10 (described later), and therefore the flat-plate terminal portion 21 is electrically connected to the mating terminal 11 (see FIG. 3).

Positioning abutment portions 24*c* as well as jig engagement step portions 24*d* are formed at those portions of the insulating housing 23 which cover the upper end edges 21*c* of the flat-plate terminal portions 21.

When the fuse 20 is mounted in the fuse mounting portion 10, the positioning abutment portions 24*c* abut against upper ends of the mating terminals 11, thereby positioning the fuse 20 in its inserted condition (see FIGS. 3 and 4).

For removing the fuse 20 mounted in the fuse mounting portion 10, a fuse removal jig (not shown) engages the jig engagement step portions 24*d*.

Figure 7:
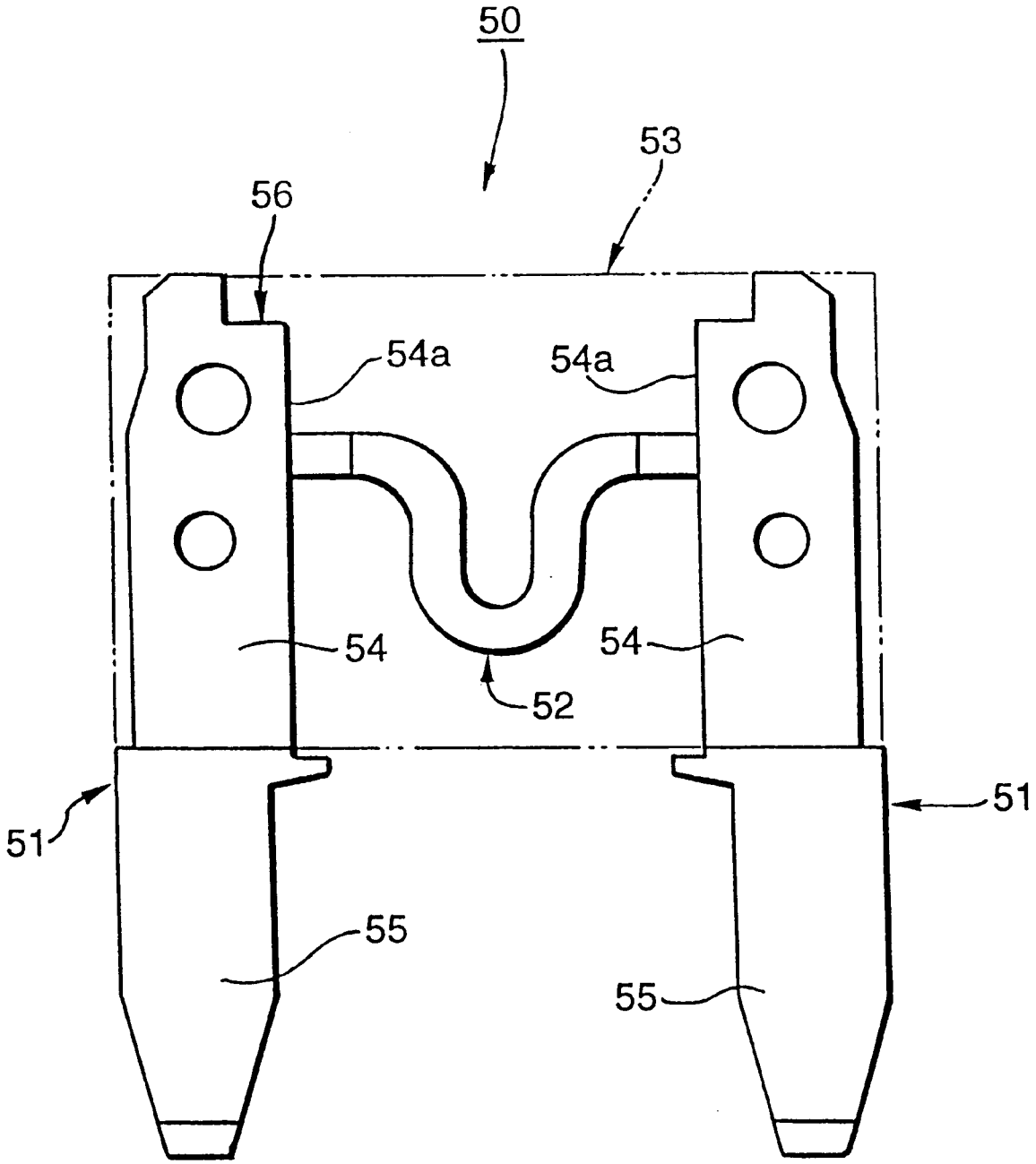
FIG. 7 PRIOR ART
FIG. 7 is a front-elevational view showing a related fuse.

Namely, in the fuse 20 of this first embodiment, the inner side edges 21*a* and upper end edges 21*c* of the flat-plate terminal portions 22, as well as the fusible portion 22, are covered with the insulating housing 23 as shown in FIG. 2, and therefore the fuse element 25 does not have any tab terminal portions (such as the tab terminal portions 55 of the related fuse 50 shown in FIG. 7) considerably projecting outwardly from the insulating housing 23, and the fuse 20 has a substantially rectangular shape when viewed from the front side thereof.

Therefore, even when a plurality of fuses 20 are brought into contact with each other during transport or others, the fuse elements 25, each having no tab terminal portion projecting from the insulating housing 23, are not liable to be brought into contact with each other, and besides are not liable to receive an external force which would be produced upon contact with other member. Therefore, the flat-plate terminal portions 21 are prevented from damage, and also an external force is prevented from being applied to the fusible portion 22, thus preventing the fusible portion 22 from being deformed or broken.

Even if the flat-plate terminal portion 21 should receive an external force upon contact of the outer side edge 21*d* or the lower end edge 21*e* with other member, the external force hardly acts directly on the fusible portion 22 since the flat-plate terminal portion 21 is supported by the pins 24*a* of the housing member 24 passing therethrough.

The fuse 20 is mounted in the fuse mounting portion 10 such as a fuse box as shown in FIGS. 3 and 4, and the middle portions 21*f* of the flat-plate terminal portions 21 are fixedly gripped respectively by the mating terminals 11 of the fuse mounting portion 10, and therefore the flat-plate terminal portions 21 are electrically connected to the mating terminals 11, respectively.

As shown in FIG. 4, the mating terminal 11 is, for example, a so-called tuning fork-type connection terminal comprising a terminal piece portion formed at one end of a bus bar, and a distal end portion of this terminal piece portion is bifurcated by a slot 61*b* of a U-shaped contour extending in a direction of extending of the terminal piece portion, and upper ends of this bifurcated distal end portion are bulged inwardly toward each other to form a pair of gripping portions 11*a* and 11*a,* respectively.

Figure 8:
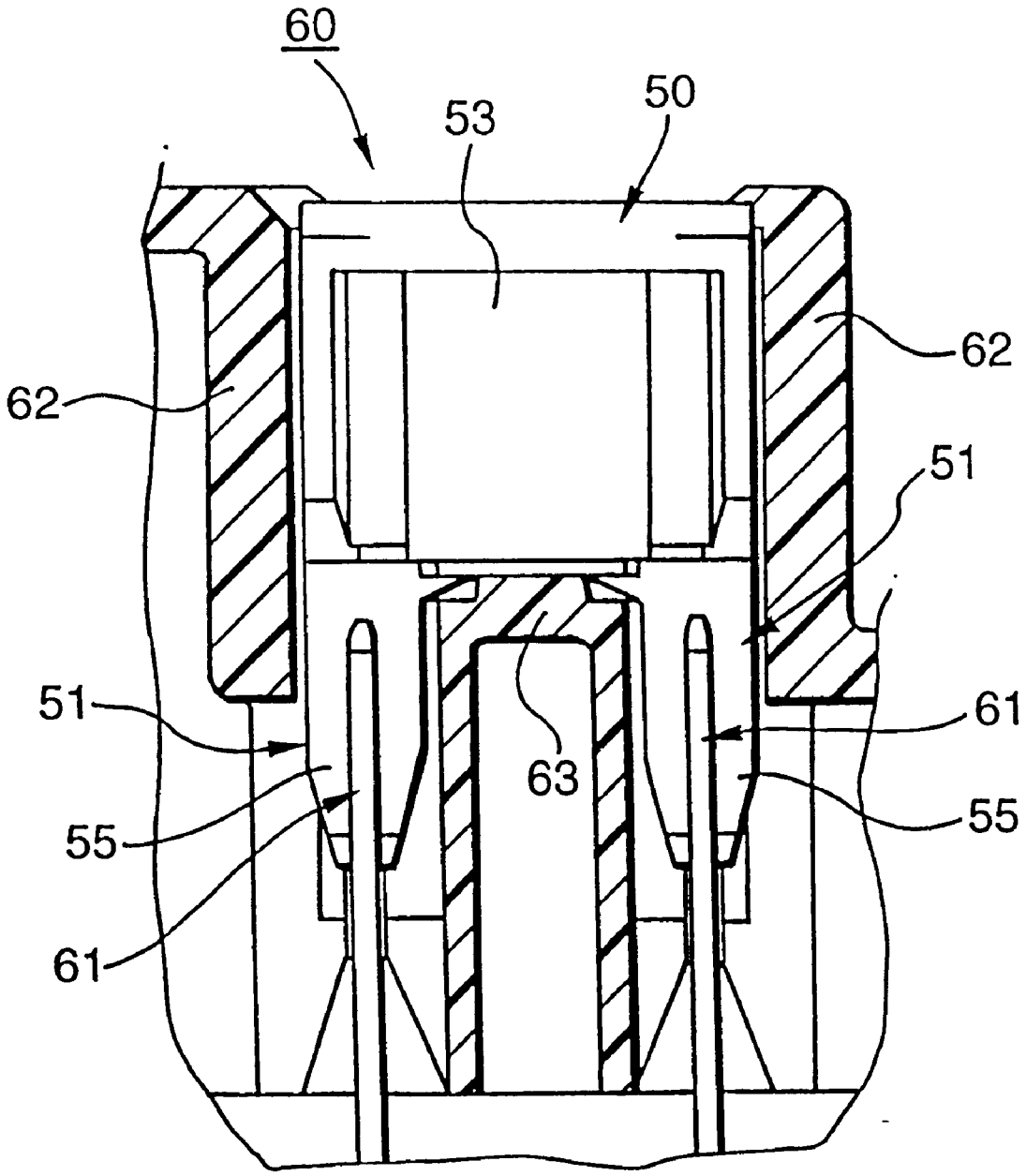
FIG. 8 PRIOR ART
FIG. 8 is a front-elevational view showing a condition in which the fuse of FIG. 7 is mounted in a fuse mounting portion.
Figure 9:
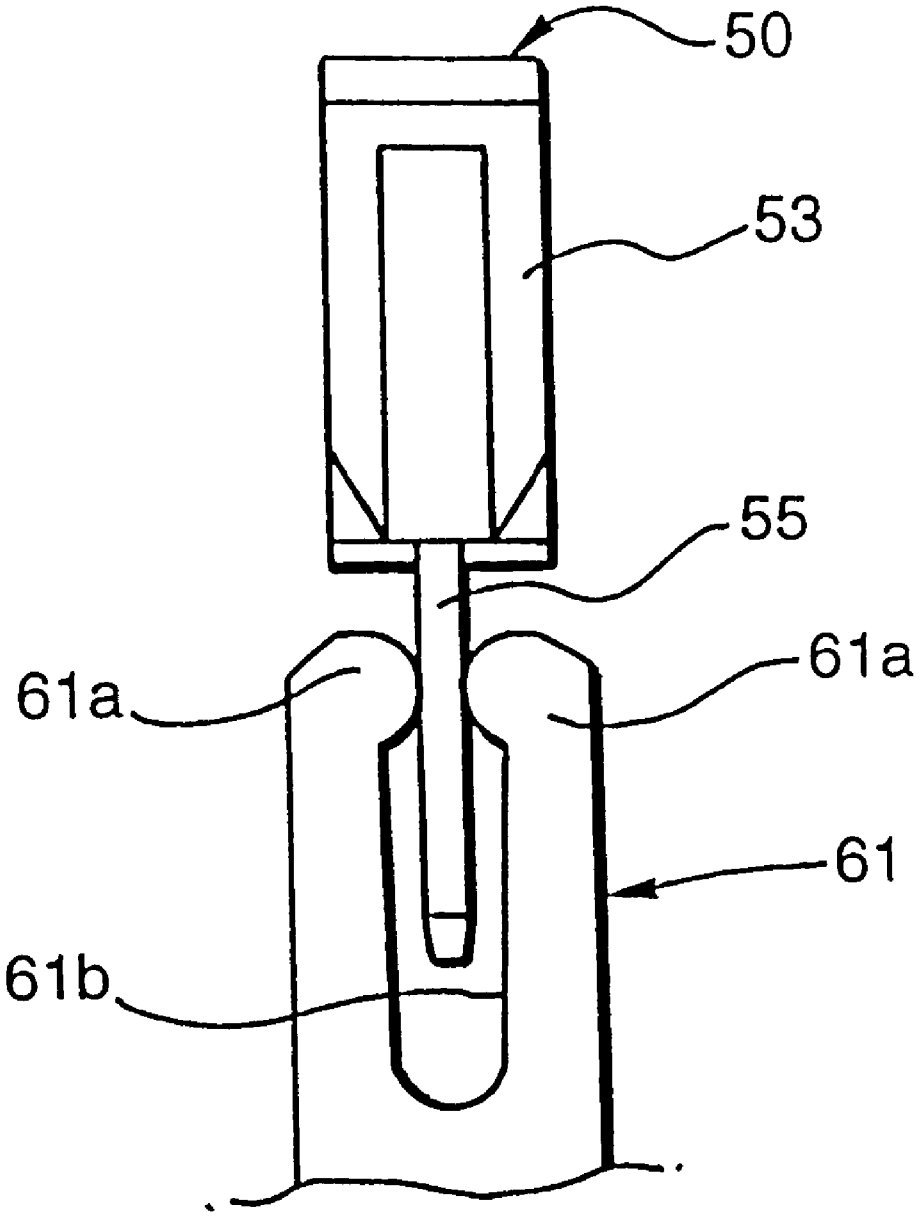
FIG. 9 PRIOR ART
FIG. 9 is a side-elevational view showing a condition in which the fuse of FIG. 7 is mounted in the fuse mounting portion.

Namely, each of the flat-plate terminal portions 21 and 21 of the fuse element 25 of the fuse 20 of this first embodiment is fixedly gripped by the mating terminal 11 at the middle portion 21*f* thereof which is substantially a central portion thereof in the mounting direction (in the upward-downward direction in the drawings). Therefore, as compared with the related fuse 50 (shown in FIGS. 8 and 9) in which the tab terminal portions 55, projecting from the insulating housing 53, are adapted to be fixedly supported, the balance of supporting of the fuse 20 in the fuse mounting portion 10 is better, and the deflection of the fuse in its mounted condition is suppressed, and besides the overall height of the fuse 20 can be reduced.

Therefore, fuse guide walls 13 of the fuse mounting portion 10, shown in FIG. 3, do not need to have a high molding precision so as to prevent the deflection and the like of the fuse 20, and also the height of the fuse guide walls 13 can be reduced.

A leakage of current between the flat-plate terminal portions 21 and 21 of the fuse 20, mounted in the fuse mounting portion 10, is prevented by the insulating housing 23. Therefore, an insulating wall 12 of the fuse mounting portion 10 need only to electrically insulate the pair of mating terminals 11 and 11 from each other, and therefore can have a smaller height as compared with the insulating wall 63 shown in FIG. 8.

Therefore, the fuse mounting portion 10 can be formed into a small size, and besides the efficiency of the operation for inserting the fuse 20 can be enhanced.

The insulating housing 23 covers the upper end edges 21*c* of the flat-plate terminal portions 21, and has the positioning abutment portions 24*c* for abutment against the upper ends of the mating terminals 11 so as to position the fuse 20 in its inserted condition.

Thus, the fuse 20 is directly positioned relative to the mating terminals 11, and therefore the fuse does not need to be positioned relative to the insulating wall 12 and others of the fuse mounting portion 10, so that the accurate positioning can be effected regardless of the molding precision of the fuse mounting portion 10.

Therefore, in the fuse 20 of this first embodiment, the flat-plate terminal portions 21 are prevented from damage, and also an external force is prevented from being applied to the fusible portion 22, thus preventing the fusible portion 22 from being deformed or broken, and therefore the reliability is enhanced, and the small-size design can be achieved.

And besides, the fuse mounting portion 10, in which the fuse 20 is to be mounted, can be formed into a small size, and is not required to have a high molding precision. Therefore, the efficiency of the operation for inserting the fuse 20, which can be easily inserted, is enhanced, and also the production cost can be reduced.

The fuse element and the insulating housing of the fuse of the present invention are not limited to the constructions in the above embodiment, but various forms can be adopted.

Figure 5:
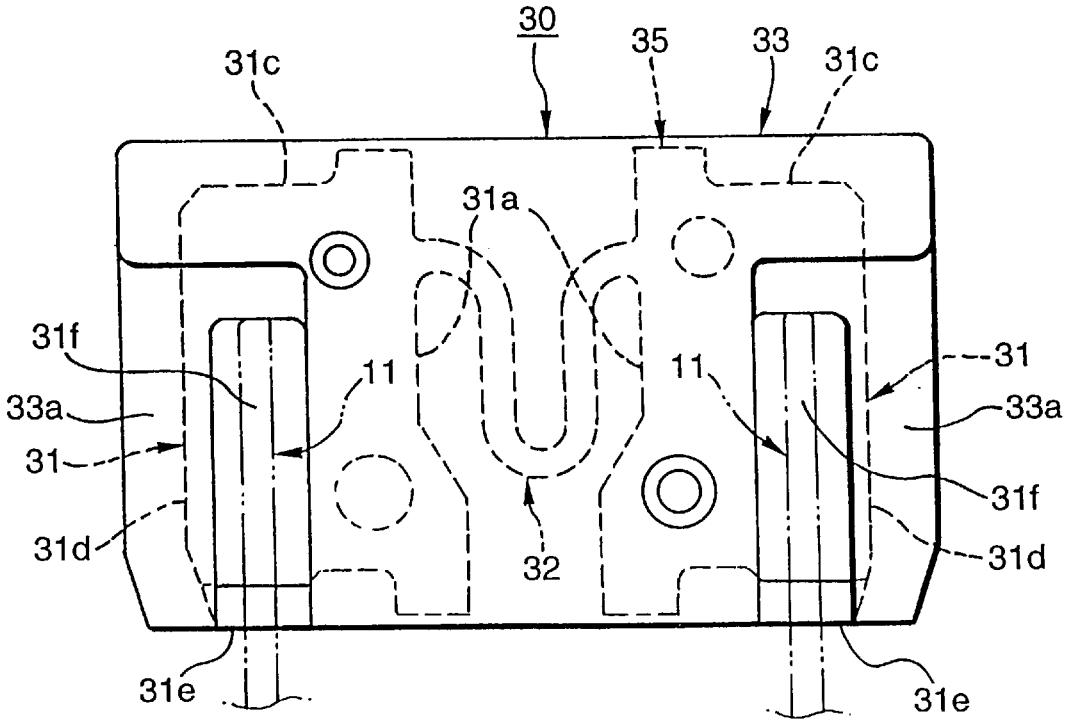
FIG. 5 is a front-elevational view showing a second embodiment of a fuse of the present invention.

For example, in a second embodiment of a fuse 30 of the present invention shown in FIG. 5, an insulating housing 33, attached to a fuse element 35, covers a fusible portion 32, inner side edges 31*a,* upper end edges 31*c* and outer side edges 31*d* of flat-plate terminal portions 31.

Therefore, the fuse element 35 is covered with the insulating housing 33 except obverse and reverse sides of that portion of each flat-plate terminal portion 31 extending from its lower end edge 3l*e* to a region including a middle portion 31*f* thereof located at the lateral position relative to the fusible portion 32.

The middle portion 31*f* of each flat-plate terminal portion 31 is fixedly gripped by the mating terminal 11 of the fuse mounting portion 10, and therefore the flat-plate terminal portion 31 is electrically connected to the mating terminal 11.

Namely, the exposure of the fuse element 35 of the fuse 30 of this second embodiment is reduced to the minimum of the required amount, and therefore the damage prevention and the protection of the fusible portion 32 can be achieved more positively. The other construction and effects are similar to those of the fuse 20 of the first embodiment.

Figure 6:
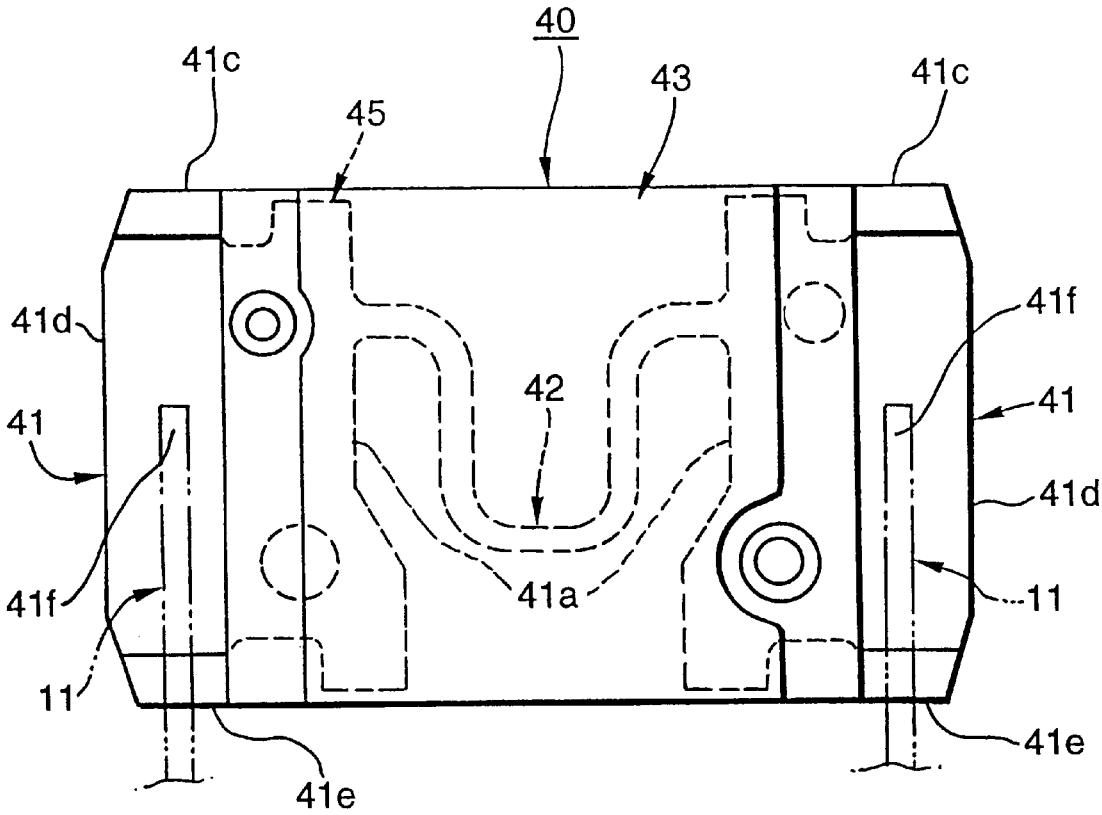
FIG. 6 is a front-elevational view showing a third embodiment of a fuse of the present invention.

In a third embodiment of a fuse 40 of the present invention shown in FIG. 6, an insulating housing 43, attached to a fuse element 45, covers a fusible portion 42 and only an inner side edge 41*a* of each flat-plate terminal portion 41, and obverse and reverse sides of that portion of each flat-plate terminal portion 41, extending from its upper end edge 41*c* and lower end edge 4l*e* to a region including a middle portion 41*f* thereof located at the lateral position relative to the fusible portion 42, are exposed from the insulating housing 43.

Namely, the fuse 40 can be mounted in the fuse mounting portion 10 from either of the upper and lower directions, and therefore the efficiency of the fuse mounting operation can be enhanced. The other construction and effects are substantially similar to those of the fuse 20 of the first embodiment.

In each of the above embodiments, although each flat-plate terminal portion 21 (31, 41) is fixedly gripped at its the middle portion 21*f* (31*f*, 41*f*) located at the lateral position relative to the fusible portion 22 (32, 42), the present invention is not limited to this construction, and in accordance with the construction of the mating terminal, each flat-plate terminal portion can be suitably fixedly gripped at its middle portion in the mounting direction, which middle portion is exposed from the insulating housing.

In the above-mentioned fuse of the present invention, the fuse element, in which the inner side edges and upper end edges of the flat-plate terminal portions and the fusible portion are covered with the insulating housing, does not have any tab terminal portions considerably projecting outwardly from the insulating housing as in the related fuse.

Therefore, even when a plurality of fuses are brought into contact with each other during transport or others, the fuse elements, each having no tab terminal portion projecting from the insulating housing, are not liable to be brought into contact with each other, and besides are not liable to receive an external force which would be produced upon contact with other member. Therefore, the flat-plate terminal portions are prevented from damage, and also an external force is prevented from being applied to the fusible portion, thus preventing the fusible portion from being deformed or broken.

The middle portion of each flat-plate terminal portion of the fuse element in the mounting direction is fixedly gripped by the mating terminal in the direction of the plate thickness of the flat-plate terminal portion. Therefore, as compared with the related fuse in which the tab portions, projecting from the insulating housing, are adapted to be fixedly supported, the balance of supporting of the fuse in the fuse mounting portion is better, and the deflection of the fuse in its mounted condition is suppressed, and besides the overall height of the fuse can be reduced.

Therefore, the fuse guide walls of the fuse mounting portion do not need to have a high molding precision so as to prevent the deflection and the like of the fuse, and also the height of the fuse guide walls can be reduced. Therefore, the fuse mounting portion can be formed into a small size, and besides the efficiency of the fuse-inserting operation can be enhanced.

What is claimed is:

1. A fuse box, comprising:

at least one fuse mounting portion, said mounting portion comprising:

a plurality of guide walls, at least two fuse mating terminals positioned at an inner position with respect to said guide walls, and an insulating wall positioned between said at least two fuse mating terminals, wherein said insulating wall is lower in height than said mating terminals, and wherein said at least two fuse mating terminals have a height such that they contact positioning abutment portions disposed on a bottom surface of a fuse housing when said fuse is inserted into said fuse mounting portion.

2. The fuse box of claim 1, wherein said fuse mating terminals are configured to fixedly grip terminal portions of a fuse.

3. The fuse box of claim 1, wherein said fuse mating terminals are configured to fixedly grip a middle portion of fuse flat-plate terminal portions in a mounting direction.

4. The fuse box of claim 1, wherein said at least two fuse mating terminals are substantially U-shaped such that each of said mating terminals have two upper end portions, and each of said upper end portions of said mating terminals have at least one protrusion, wherein each of said protrusions on respective pairs of said upper end portions extend towards each other.

5. A fuse box, comprising:

at least one fuse mounting portion, said mounting portion comprising:

a plurality of guide walls, at least two fuse mating terminals positioned at an inner position with respect to said guide walls, and an insulating wall positioned between said at least two fuse mating terminals, wherein said insulating wall is lower in height than said mating terminals, and wherein said insulating wall has a height such that said insulating wall contacts a fuse when said fuse is inserted into said fuse mounting portion.

6. The fuse box of claim 5, wherein said fuse mating terminals are configured to fixedly grip terminal portions of a fuse.

7. The fuse box of claim 5, wherein said fuse mating terminals are configured to fixedly grip a middle portion of fuse flat-plate terminal portions in a mounting direction.

8. The fuse box of claim 5, wherein said at least two fuse mating terminals have a height such that they contact positioning abutment portions of a fuse when said fuse is inserted into said fuse mounting portion.

9. The fuse box of claim 5, wherein said at least two fuse mating terminals are substantially U-shaped such that each of said mating terminals have two upper end portions, and each of said upper end portions of said mating terminals have at least one protrusion, wherein each of said protrusions on respective pairs of said upper end portions extend towards each other.

10. A fuse box, comprising:

at least one fuse mounting portion, said mounting portion comprising:

a plurality of guide walls, at least two fuse mating terminals positioned at an inner position with respect to said guide walls, and an insulating wall positioned between said at least two fuse mating terminals, wherein said insulating wall is lower in height than said mating terminals, and wherein at least one of said guide walls guides a side wall of a fuse by contacting said side wall when said fuse is inserted into said fuse mounting portion.

11. The fuse box of claim 10, wherein said fuse mating terminals are configured to fixedly grip terminal portions of a fuse.

12. The fuse box of claim 10, wherein said fuse mating terminals are configured to fixedly grip a middle portion of fuse flat-plate terminal portions in a mounting direction.

13. The fuse box of claim 10, wherein said at least two fuse mating terminals have a height such that they contact positioning abutment portions of a fuse when said fuse is inserted into said fuse mounting portion.

14. The fuse box of claim 10, wherein said at least two fuse mating terminals are substantially U-shaped such that each of said mating terminals have two upper end portions, and each of said upper end portions of said mating terminals have at least one protrusion, wherein each of said protrusions on respective pairs of said upper end portions extend towards each other.

* * * * *